US005153652A

United States Patent [19]

Zoltner

[11] Patent Number: 5,153,652

[45] Date of Patent: Oct. 6, 1992

[54] DEVELOPED IMAGE TRANSFER APPARATUS AND METHOD WITH GAS DIRECTING MEANS

[75] Inventor: Susan J. Zoltner, Rochester, N.Y.

[73] Assignee: Xerox Corporation, Stamford, Conn.

[21] Appl. No.: 806,574

[22] Filed: Dec. 12, 1991

[51] Int. Cl.[5] ..... G03G 15/14

[52] U.S. Cl. ..... 355/273; 355/271

[58] Field of Search ..... 355/271, 273, 274, 276, 355/312, 308, 309

[56] References Cited

U.S. PATENT DOCUMENTS

| | | | |
|---|---|---|---|
| 3,641,605 | 2/1972 | Lindsay | 355/296 X |
| 3,836,245 | 9/1974 | Hastwell et al. | 355/296 X |
| 3,949,671 | 4/1976 | Madigan | 101/232 |
| 3,977,779 | 8/1976 | Brooke | 355/312 |
| 4,169,673 | 10/1979 | Sato et al. | 355/274 |
| 4,384,524 | 5/1983 | Simeth et al. | 101/232 |
| 4,947,214 | 8/1990 | Baxendell et al. | 358/274 |
| 5,023,665 | 6/1991 | Gundlach | 355/256 |

*Primary Examiner*—A. T. Grimley
*Assistant Examiner*—William J. Royer
*Attorney, Agent, or Firm*—Paul J. Maginot

[57] ABSTRACT

An apparatus for transferring a developed image from a photoconductive surface to a copy sheet in a transfer zone is disclosed. The apparatus includes a mechanism for directing a flow of gas onto the copy sheet in the transfer zone to urge the copy sheet toward the developed image on the photoconductive surface so as to enhance contact between the copy sheet and the developed image in the transfer zone. The apparatus further includes a mechanism for charging the copy sheet in the transfer zone, after the gas directing mechanism directs the flow of gas onto the copy sheet, to attract the developed image from the photoconductive surface to the copy sheet. Also disclosed is a method of transferring a developed image from a photoconductive surface to a copy sheet in a transfer zone. The method includes the step of directing a flow of gas onto the copy sheet in the transfer zone to urge the copy sheet toward the developed image on the photoconductive surface so as to enhance contact between the copy sheet and the developed image in the transfer zone. The method further includes the step of establishing, in the transfer zone and after the gas directing step, a transfer field that is effective to attract the developed image from the photoconductive surface to the copy sheet.

7 Claims, 7 Drawing Sheets

DEVELOPED IMAGE TRANSFER APPARATUS AND METHOD WITH GAS DIRECTING MEANS

This invention relates generally to an electrophotographic printing machine, and more particularly concerns an apparatus for transferring a developed image from a photoconductive surface to a copy sheet.

The marking engine of an electronic reprographic printing system is frequently an electrophotographic printing machine. In an electrophotographic printing machine, a photoconductive member is charged to a substantially uniform potential to sensitize the surface thereof. The charged portion of the photoconductive member is thereafter selectively exposed in an imaging zone to a light source such as a raster output scanner. Exposure of the charged photoconductive member dissipates the charge thereon in the irradiated areas. This records an electrostatic latent image on the photoconductive member corresponding to the informational areas contained within the original document being reproduced. After the electrostatic latent image is recorded on the photoconductive member, the latent image is developed by bringing a developer material into contact therewith. Generally, the developer material comprises toner particles adhering triboelectrically to carrier granules. The toner particles are attracted to the latent image from the carrier granules to form a toner image on the photoconductive member which is subsequently transferred to a copy sheet. The copy sheet is then heated to permanently affix the toner image thereto in image configuration.

Multi-color electrophotographic printing is substantially identical to the foregoing process of black and white printing. However, rather than forming a single latent image on the photoconductive surface, successive latent images corresponding to different colors are recorded thereon. Each single color electrostatic latent image is developed with toner of a color complimentary thereto. This process is repeated a plurality of cycles for differently colored images and their respective complimentarily colored toner. Each single color toner image is transferred to the copy sheet in superimposed registration with the prior toner image. This creates a multi-layered toner image on the copy sheet. Thereafter, the multi-layered toner image is permanently affixed to the copy sheet creating a color copy.

With regard to the electrostatic transfer process, the copy sheet is moved into contact with the photoconductive member, in synchronism with the toner image developed thereon. The copy sheet then adheres to the photoconductive member with the toner image being interposed between the photoconductive member and the copy sheet. A problem may occur in the transfer process when spaces or gaps exist between between the developed image on the photoconductive member and the copy sheet. These spaces are sometimes caused by deformations or wrinkles in the copy sheet or by an excessive build up of toner particles on the photoconductive member. In the process of transferring the developed toner image to the copy sheet, it is desirable for the copy sheet to be in substantial uniform contact with the toner image developed on the photoconductive member. Failure to do so results in variable transfer efficiency and, in extreme cases, areas of low or no transfer resulting in image deletions. An image deletion is obviously very undesirable in that useful information or indicia are not reproduced on the copy sheet.

One system that has been designed to reduce the occurrence of image deletions utilizes a blade member which is brought into contact with the backside of the copy sheet during the electrostatic transfer process. The above design requires raising and lowering of the blade member in order to avoid interference with the leading edge of the copy sheet. Moreover, damage to the photoconductive member may occur as a result of any physical contact between the blade member and the photoconductive member. It would be desirable to provide a mechanism that minimizes the incidence of image deletions which has less mechanical parts and is financially less expensive to manufacture. It would also be desirable to provide such a mechanism which reduces the risk of damage to the photoconductive member.

The following disclosures may be relevant to various aspects of the present invention:

U.S. Pat. No. 3,949,671, Patentee: Madigan, Issued: Apr. 13, 1976.

U.S. Pat. No. 3,977,779, Patentee: Brooke, Issued: Aug. 31, 1976.

U.S. Pat. No. 4,384,524, Patentee: Simeth et al., Issued: May 24, 1983.

U.S. Pat. No. 4,947,214, Patentee: Baxendell et al., Issued: Aug. 7, 1990.

U.S. Pat. No. 5,023,665, Patentee: Gundlach, Issued: Jun. 11, 1991.

The relevant portions of the foregoing disclosures may be briefly summarized as follows:

U.S. Pat. No. 3,949,671 discloses a printing station including an impression cylinder and a plate cylinder that is positioned adjacent an air applicator which causes paper emerging from the nip of the cylinders to be pressed against an arcuate portion of the impression cylinder so as to be driven over a paper guide means which forwards the paper to a stacking station. The air applicator is designed to produce some air travel in the direction of motion of the inked paper to assist in driving the paper and drying the ink.

U.S. Pat. No. 3,977,779 describes an electrostatic system in which liquid developer material in an image pattern on a photoconductive plate is transferred to a support material by pressing the latter against the plate by air pressure from a perforated chamber adjacent to, but spaced from the plate. The perforations may be angled in the direction of movement of the plate, and the chamber may have an inclined wall.

U.S. Pat. No. 4,384,524 describes a device for seating and spreading a conveyed sheet evenly on an impression cylinder of a printing press in order to prevent fluttering of the sheet. The device includes a pair of pipes and a top wall which define a plenum chamber adjacent the surface of the cylinder. Air, supplied to the pipes, is directed into the chamber thereby building up a pressure head in the chamber. Such pressure head presses upon and tends to spread a conveyed sheet evenly on the surface of the cylinder. The chamber is vented through a restriction to limit the pressure which is in the chamber and which is applied to the sheet.

U.S. Pat. No. 4,947,214 discloses an apparatus which transfers a developed image from a photoconductive surface to a copy sheet. The apparatus includes a corona generating device arranged to charge the copy sheet. This establishes a transfer field that is effective to attract the developed image from the photoconductive surface to the copy sheet. A blade is moved from a nonoperative position spaced from the copy sheet, to an operative position, in contact therewith. The blade presses the copy sheet into contact with at least the developed image on the photoconductive surface to substantially eliminate any spaces between the copy sheet and the developed image during transfer of the developed image from the photoconductive surface to the copy sheet.

U.S. Pat. No. 5,023,665 describes a printing machine of the type in which a toner particle image and liquid carrier are transferred from a moving member to a sheet of support material. The printing machine includes vacuum means, positioned closely adjacent the moving member to define a gap therebetween, for withdrawing air and liquid carrier from the gap before transfer of the toner particle image to the sheet of support material. The printing machine further includes means for electrically biasing the vacuum means to generate an electrical field sufficient to maintain the toner particle image substantially undisturbed as the vacuum means withdraws air and liquid carrier from the gap.

In accordance with one aspect of the present invention, there is provided an apparatus for transferring a developed image from a photoconductive surface to a copy sheet in a transfer zone. The apparatus includes a mechanism for directing a flow of gas onto the copy sheet in the transfer zone to urge the copy sheet toward the developed image on the photoconductive surface so as to enhance contact between the copy sheet and the developed image in the transfer zone. The apparatus further includes a mechanism for charging the copy sheet in the transfer zone, after the gas directing mechanism directs the flow of gas onto the copy sheet, to attract the developed image from the photoconductive surface to the copy sheet.

Pursuant to another aspect of the present invention, there is provided a method of transferring a developed image from a photoconductive surface to a copy sheet in a transfer zone. The method includes the step of directing a flow of gas onto the copy sheet in the transfer zone to urge the copy sheet toward the developed image on the photoconductive surface so as to enhance contact between the copy sheet and the developed image in the transfer zone. The method further includes the step of establishing, in the transfer zone and after the gas directing step, a transfer field that is effective to attract the developed image from the photoconductive surface to the copy sheet.

Other features of the present invention will become apparent as the following description proceeds and upon reference to the drawings, in which.

While the present invention will hereinafter be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

Figure 1:
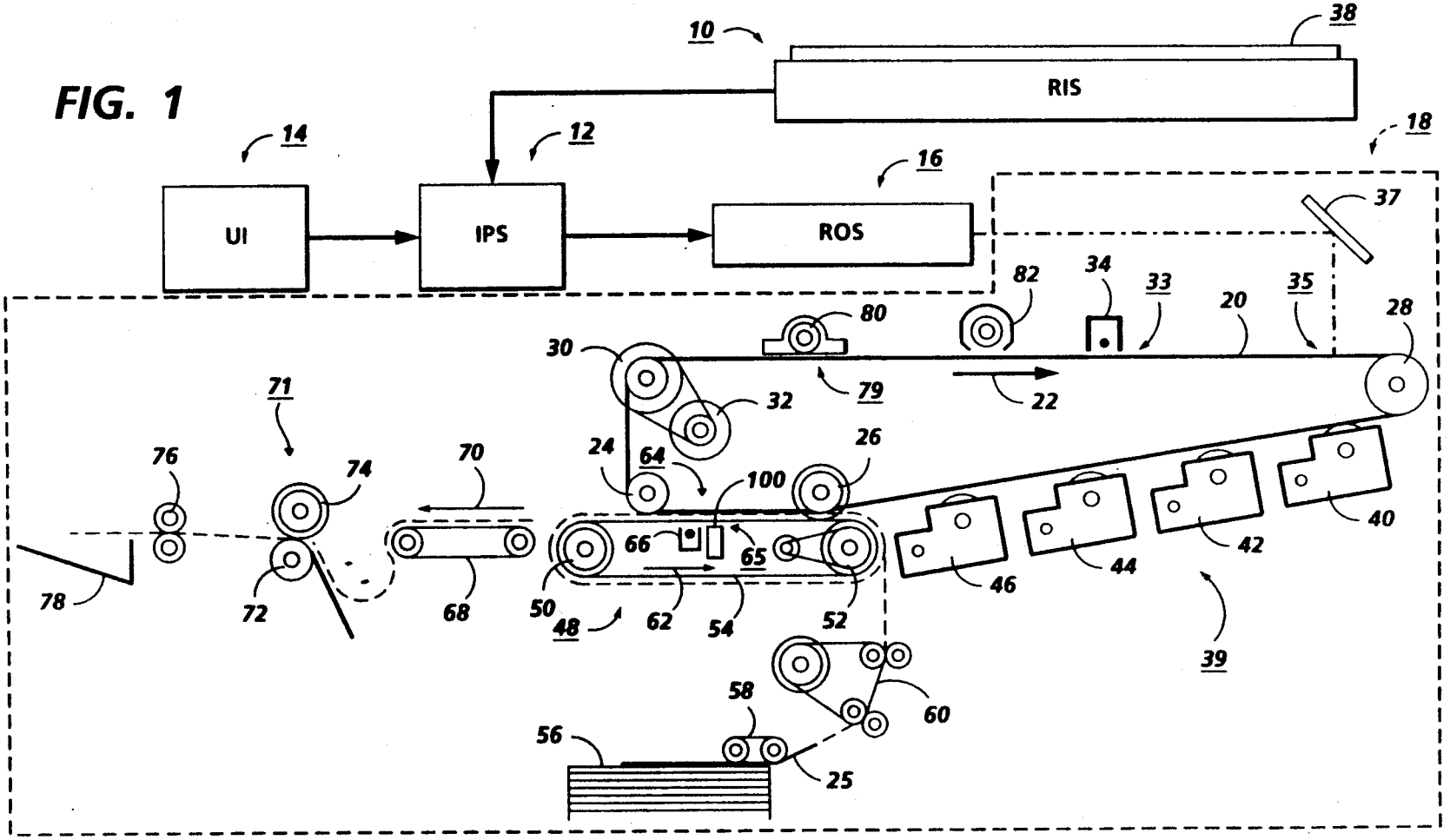
FIG. 1 is a schematic elevational view showing an electrophotographic printing machine incorporating the features of the present invention therein.

For a general understanding of the features of the present invention, reference is made to the drawings. In the drawings, like references have been used throughout to designate identical elements. FIG. 1 is a schematic elevational view showing an electrophotographic printing machine incorporating the features of the present invention therein. It will become evident from the following discussion that the present invention is equally well suited for use in a wide variety of printing systems, and is not necessarily limited in its application to the particular system shown herein.

Turning initially to FIG. 1, during operation of the printing system, a multi-color original document 38 is positioned on a raster input scanner (RIS), indicated generally by the reference numeral 10. The RIS contains document illumination lamps, optics, a mechanical scanning drive, and a charge coupled device (CCD array). The RIS captures the entire image from original document 38 and converts it to a series of raster scan lines and moreover measures a set of primary color densities, i.e. red, green and blue densities, at each point of the original document. This information is transmitted as electrical signals to an image processing system (IPS), indicated generally by the reference numeral 12. IPS 12 converts the set of red, green and blue density signals to a set of colorimetric coordinates. The IPS contains control electronics which prepare and manage the image data flow to a raster output scanner (ROS), indicated generally by the reference numeral 16. A user interface (UI), indicated generally by the reference numeral 14, is in communication with IPS 12. UI 14 enables an operator to control the various operator adjustable functions. The operator actuates the appropriate keys of UI 14 to adjust the parameters of the copy. UI 14 may be a touch screen, or any other suitable control panel, providing an operator interface with the system. The output signal from UI 14 is transmitted to IPS 12. The IPS then transmits signals corresponding to the desired image to ROS 16, which creates the output copy image. ROS 16 includes a laser with rotating polygon mirror blocks. Preferably, a nine facet polygon is used. The ROS illuminates, via mirror 37, the charged portion of a photoconductive belt 20 of a printer or marking engine, indicated generally by the reference numeral 18, at a rate of about 400 pixels per inch, to achieve a set of subtractive primary latent images. The ROS will expose the photoconductive belt to record three latent images which correspond to the signals transmitted from IPS 12. One latent image is developed with cyan developer material. Another latent image is developed with magenta developer material and the third latent image is developed with yellow developer material. These developed images are transferred to a copy sheet in superimposed registration with one another to form a multi-colored image on the copy sheet. This multi-colored image is then fused to the copy sheet forming a color copy.

With continued reference to FIG. 1, printer or marking engine 18 is an electrophotographic printing machine. Photoconductive belt 20 of marking engine 18 is preferably made from a polychromatic photoconductive material. The photoconductive belt moves in the direction of arrow 22 to advance successive portions of the photoconductive surface sequentially through the various processing stations disposed about the path of movement thereof. Photoconductive belt 20 is entrained about transfer rollers 24 and 26, tensioning roller 28, and drive roller 30. Drive roller 30 is rotated by a motor 32 coupled thereto by suitable means such as a belt drive. As roller 30 rotates, it advances belt 20 in the direction of arrow 22.

Initially, a portion of photoconductive belt 20 passes through a charging station, indicated generally by the reference numeral 33. At charging station 33, a corona generating device 34 charges photoconductive belt 20 to a relatively high, substantially uniform potential.

Next, the charged photoconductive surface is rotated to an exposure station, indicated generally by the reference numeral 35. Exposure station 35 receives a modulated light beam corresponding to information derived by RIS 10 having multi-colored original document 38 positioned thereat. The modulated light beam impinges on the surface of photoconductive belt 20. The beam illuminates the charged portion of the photoconductive belt to form an electrostatic latent image. The photoconductive belt is exposed three times to record three latent images thereon.

After the electrostatic latent images have been recorded on photoconductive belt 20, the belt advances such latent images to a development station, indicated generally by the reference numberal 39. The development station includes four individual developer units indicated by reference numerals 40, 42, 44 and 46. The developer units are of a type generally referred to in the art as "magnetic brush development units." Typically, a magnetic brush development system employs a magnetizable developer material including magnetic carrier granules having toner particles adhering triboelectrically thereto. The developer material is continually brought through a directional flux field to form a brush of developer material. The developer material is constantly moving so as to continually provide the brush with fresh developer material. Development is achieved by bringing the brush of developer material into contact with the photoconductive surface. Developer units 40, 42, and 44, respectively, apply toner particles of a specific color which corresponds to the compliment of the specific color separated electrostatic latent image recorded on the photoconductive surface. The color of each of the toner particles is adapted to absorb light within a preselected spectral region of the electromagnetic wave spectrum. For example, an electrostatic latent image formed by discharging the portions of charge on the photoconductive belt corresponding to the green regions of the original document will record the red and blue portions as areas of relatively high charge density on photoconductive belt 20, while the green areas will be reduced to a voltage level ineffective for development. The charged areas are then made visible by having developer unit 40 apply green absorbing (magenta) toner particles onto the electrostatic latent image recorded on photoconductive belt 20. Similarly, a blue separation is developed by developer unit 42 with blue absorbing (yellow) toner particles, while the red separation is developed by developer unit 44 with red absorbing (cyan) toner particles. Developer unit 46 contains black toner particles and may be used to develop the electrostatic latent image formed from a black and white original document. Each of the developer units is moved into and out of an operative position. In the operative position, the magnetic brush is substantially adjacent the photoconductive belt, while in the non-operative position, the magnetic brush is spaced therefrom. In FIG. 1, developer unit 40 is shown in the operative position with developer units 42, 44 and 46 being in the non-operative position. During development of each electrostatic latent image, only one developer unit is in the operative position, the remaining developer units are in the non-operative position. This insures that each electrostatic latent image is developed with toner particles of the appropriate color without commingling.

After development, the toner image is moved to a transfer station, indicated generally by the reference numeral 65. Transfer station 65 includes a transfer zone, generally indicated by reference numeral 64. In transfer zone 64, the toner image is transferred to a sheet of support material, such as plain paper amongst others. At transfer station 65, a sheet transport apparatus, indicated generally by the reference numeral 48, moves the sheet into contact with photoconductive belt 20. Sheet transport 48 has a pair of spaced belts 54 entrained about a pair of substantially cylindrical rollers 50 and 52. A sheet gripper 84 (not shown in FIG. 1) extends between belts 54 and moves in unison therewith. A sheet 25 is advanced from a stack of sheets 56 disposed on a tray. A friction retard feeder 58 advances the uppermost sheet from stack 56 onto a pre-transfer transport 60. Transport 60 advances sheet 25 to sheet transport 48. Sheet 25 is advanced by transport 60 in synchronism with the movement of the sheet gripper. In this way, the leading edge of sheet 25 arrives at a preselected position, i.e. a loading zone, to be received by the open sheet gripper. The sheet gripper then closes securing sheet 25 thereto for movement therewith in a recirculating path. The leading edge of sheet 25 is secured releasably by the sheet gripper. As belts 54 move in the direction of arrow 62, the sheet moves into contact with the photoconductive belt, in synchronism with the toner image developed thereon. In transfer zone 64, a gas directing mechanism 100 directs a flow of gas onto sheet 25 to urge the sheet toward the developed toner image on photoconductive member 20 so as to enhance contact between the sheet and the developed toner image in the transfer zone. Further in transfer zone 64, a corona generating device 66 sprays ions onto the backside of the sheet so as to charge the sheet to the proper magnitude and polarity for attracting the toner image from photoconductive belt 20 thereto. The sheet remains secured to the sheet gripper so as to move in a recirculating path for three cycles. In this way, three different color toner images are transferred to the sheet in superimposed registration with one another. One skilled in the art will appreciate that the sheet may move in a recirculating path for four cycles when under color black removal is used. Each of the electrostatic latent images recorded on the photoconductive surface is developed with the appropriately colored toner and transferred, in superimposed registration with one another, to the sheet to form the multi-color copy of the colored original document.

After the last transfer operation, the sheet transport system directs the sheet to a vacuum conveyor 68. Vacuum conveyor 68 transports the sheet, in the direction of arrow 70, to a fusing station, indicated generally by the reference numeral 71, where the transferred toner image is permanently fused to the sheet. The fusing station includes a heated fuser roll 74 and a pressure roll 72. The sheet passes through the nip defined by fuser roll 74 and pressure roll 72. The toner image contacts fuser roll 74 so as to be affixed to the sheet. Thereafter, the sheet is advanced by a pair of rolls 76 to a catch tray 78 for subsequent removal therefrom by the machine operator.

The last processing station in the direction of movement of belt 20, as indicated by arrow 22, is a cleaning station, indicated generally by the reference numeral 79. A rotatably mounted fibrous brush 80 is positioned in the cleaning station and maintained in contact with photoconductive belt 20 to remove residual toner particles remaining after the transfer operation. Thereafter, lamp 82 illuminates photoconductive belt 20 to remove any residual charge remaining thereon prior to the start of the next successive cycle.

Figure 2:
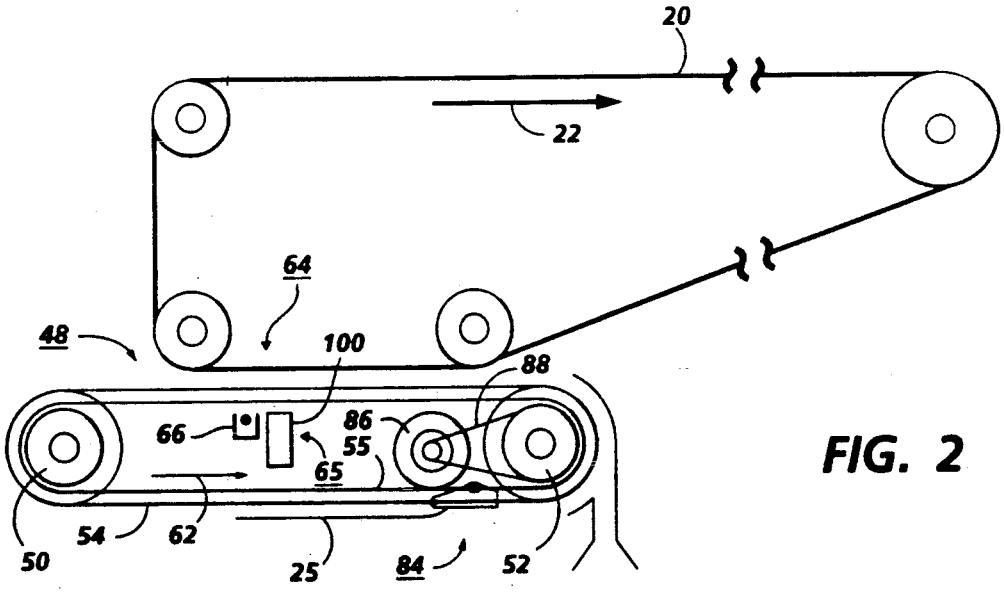
FIG. 2 is a schematic elevational view showing further details of the sheet transport system used in the electrophotographic printing machine of FIG. 1.
Figure 3:
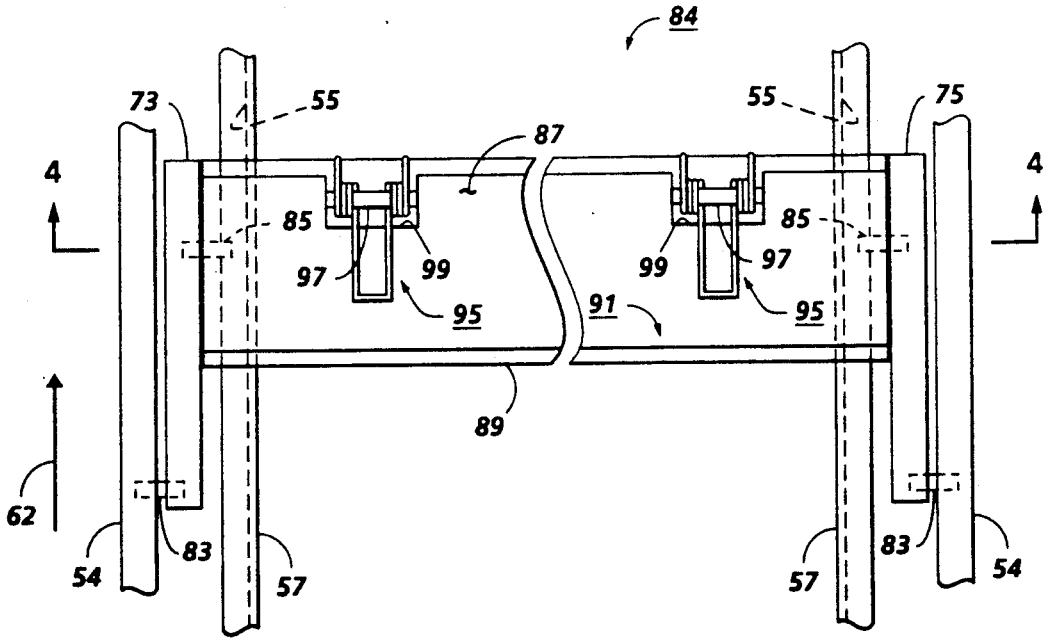
FIG. 3 is a schematic planar view showing the sheet gripper of the sheet transport system used in the electrophotographic printing machine of FIG. 1.
Figure 4:
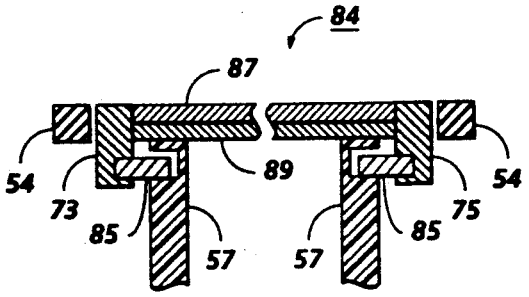
FIG. 4 is a sectional elevation view taken in the direction of arrows 4—4 in FIG. 3 of the opposed side marginal regions of the sheet gripper.

FIG. 2 shows sheet gripper 84 of sheet transport 48 transporting sheet 25 in the direction of arrow 62 in a recirculating path of movement. FIG. 3 shows sheet gripper 84 suspended between two spaced apart timing belts 54. FIG. 4 shows a sectional elevational view of the opposed side marginal regions of sheet gripper 84. Referring to FIGS. 2–4, timing belts 54 are mounted on rollers 50 and 52. Belts 54 define a continuous path of movement of sheet gripper 84. A motor 86 is coupled to roller 52 by a drive belt 88. Sheet gripper 84 includes a pair of guide members 85. A pair of spaced apart and continuous tracks 55 are respectively positioned substantially adjacent belts 54. Tracks 55 are respectively defined by a pair of track supports 57. Each of guide members 85 are slidably positioned within a respective track 55. Sheet gripper 84 further includes an upper gripping portion 87 and a lower gripping portion 89 which are biased toward each other by a plurality of springs, each being generally indicated by the reference numeral 95 (see FIGS. 3–6). Gripping portions 87 and 89 are respectfully connected to a pair of gripper supports 73 and 75 as shown in FIGS. 3–4. A plurality of securing pins 97 are respectively positioned within apertures 99 of upper gripping portion 87 and secured thereto to hold springs 95 in place so as to bias upper gripping portion 87 toward lower gripping portion 89.

Figure 5:
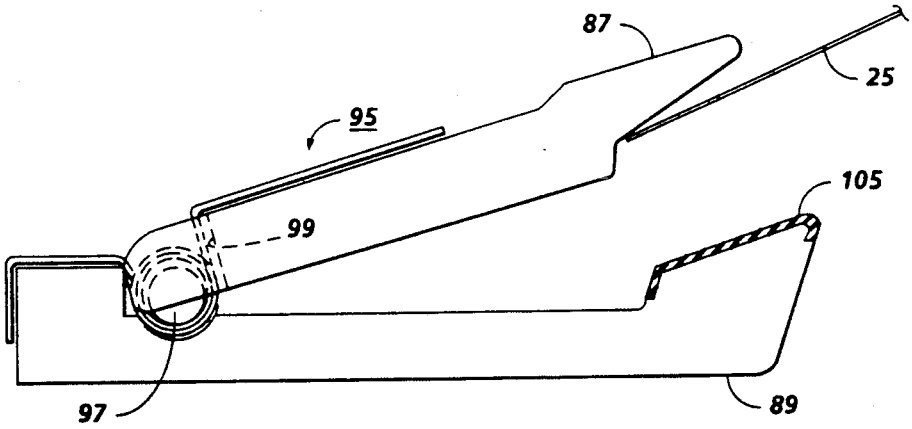
FIG. 5 is a schematic elevational view of the gripping portions of the sheet gripper of the sheet transport system used in the electrophotographic printing machine of FIG. 1 with the sheet gripper in the open position and further showing a sheet within the gripping nip.
Figure 6:
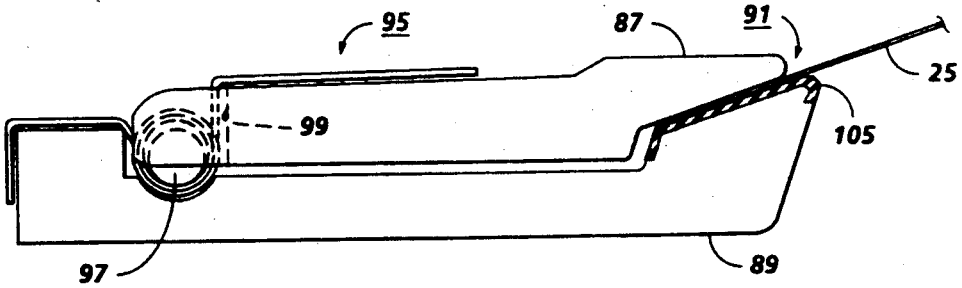
FIG. 6 is a schematic elevational view of the gripping portions of the sheet gripper of the sheet transport system used in the electrophotographic printing machine of FIG. 1 with the sheet gripper in the closed position and further showing a sheet secured within the sheet gripper.

The sheet gripper may further include a pair of cam followers (not shown) which are attached to the opposed side marginal regions of upper gripping portion 87 and function with a pair of cams (not shown) to open and close the gripping portions at predetermined intervals. FIG. 5 shows the orientation of upper gripping portion 87 relative to lower gripping portion 89 when the cam followers are actuated to overcome the bias of springs 95. FIG. 6 shows the orientation of upper gripping portion 87 relative to lower gripping portion 89 when the cam followers are moved to a non-actuated position. The cam follower is in this position when they are not in contact with the cams. In the closed position, upper gripping portion 87 cooperates with lower gripping portion 89 to grasp and securely hold the leading edge of sheet 25. The area at which the gripping portions 87 and 89 grasp sheet 25 defines a gripping nip, generally indicated by the reference numeral 91 (see FIGS. 3 and 6). Positioned upon lower gripping portion 89, near gripping nip 91, is a silicone rubber coating 105 (see FIGS. 5 and 6). With coating 105 positioned as above, the frictional grip of sheet 25 between the gripping portions is increased. Belts 54 are respectively connected to gripper supports 73 and 75 by a pair of pins 83. The belts are connected to the sheet gripper behind the leading edge of sheet 25 relative to the forward direction of movement of belts 54, as indicated by arrow 62, when sheet 25 is being transported by sheet transport 48. The sheet gripper is driven by the belts at the locations where the sheet gripper and the belts are connected.

Figure 7:
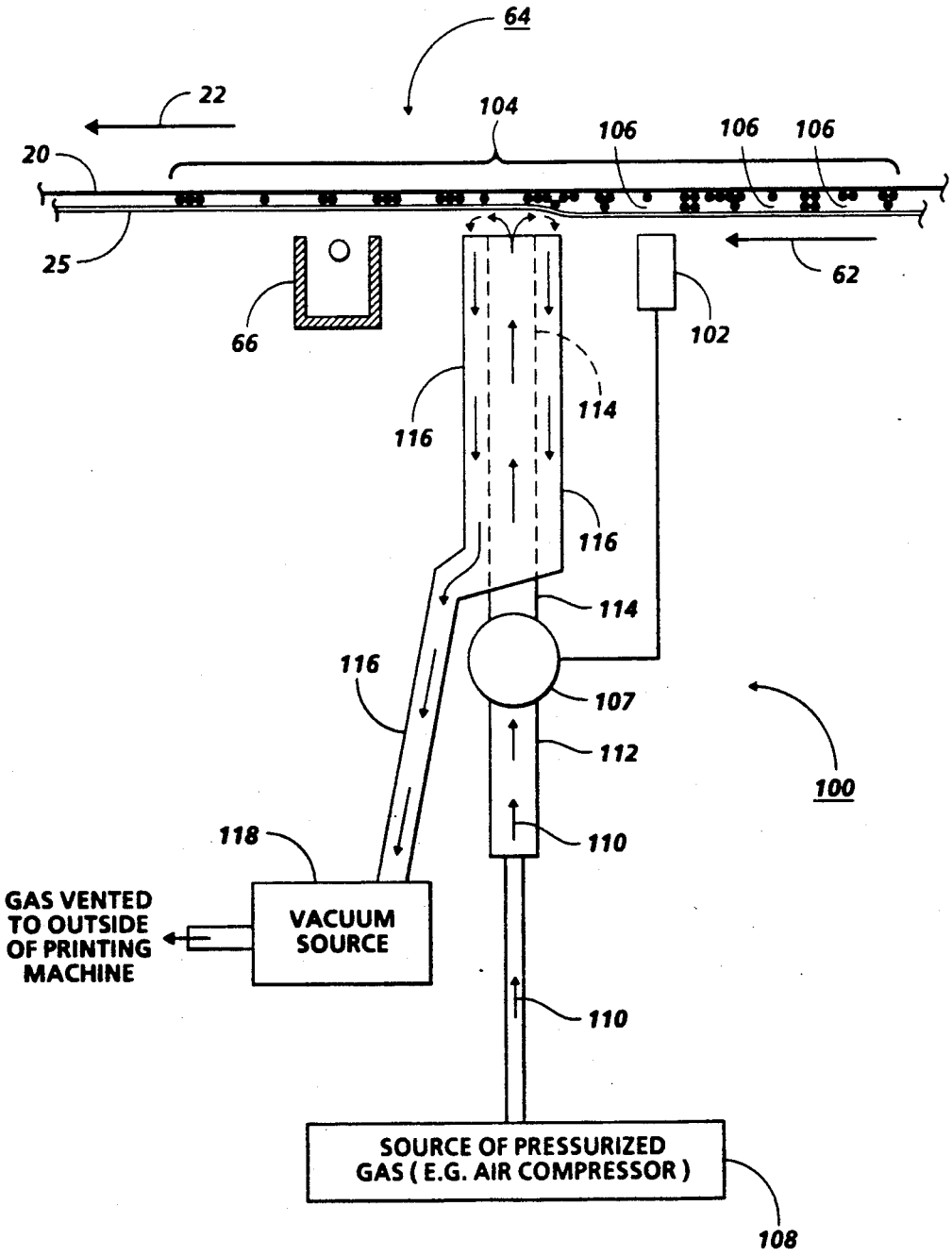
FIG. 7 is a schematic elevational view showing further details of the gas directing mechanism used in the electrophotographic printing machine of FIG. 1.

FIG. 7 shows gas directing mechanism 100 in further detail. The gas directing mechanism includes a source of pressurized gas 108. The gas source 108 may be an air compressor and the gas used thereby is preferably ambient room air. The flow of gas generated by gas source 108 is initially directed through a first plenum chamber 112 in the direction of arrows 110. Thereafter, the flow of gas passes through a solenoid actuated valve 107 and then through a second plenum chamber 114. Once the flow of gas exits second plenum chamber 114, the flow of gas strikes sheet 25 so as to urge the sheet toward a developed powder toner image 104 positioned on photoconductive member 20 thereby enhancing contact between the sheet and the developed image. The gas is then vented away from sheet 25 with the assistance of a vacuum source 118 through a third plenum chamber 116 and then to the outside of the printing machine. Second plenum chamber 114 and third plenum chamber 116 each preferably substantially spans the width of sheet 25 so that as the sheet is advanced thereby the entire width of the sheet is urged toward the developed image.

The flow of gas is selectively allowed to pass from first plenum chamber 112 to second plenum chamber 114 by valve 107. The valve is actuated to open and close in response to a signal transmitted from a sensor 102 which detects the leading edge of sheet 25. A second solenoid actuated valve (not shown) may be positioned within the venting path of third plenum chamber 116 in order to selectively apply vacuum action near the area at which the flow of gas exits second plenum chamber 114. The second valve may be actuated to open and close in synchronism with valve 107.

Figure 8:
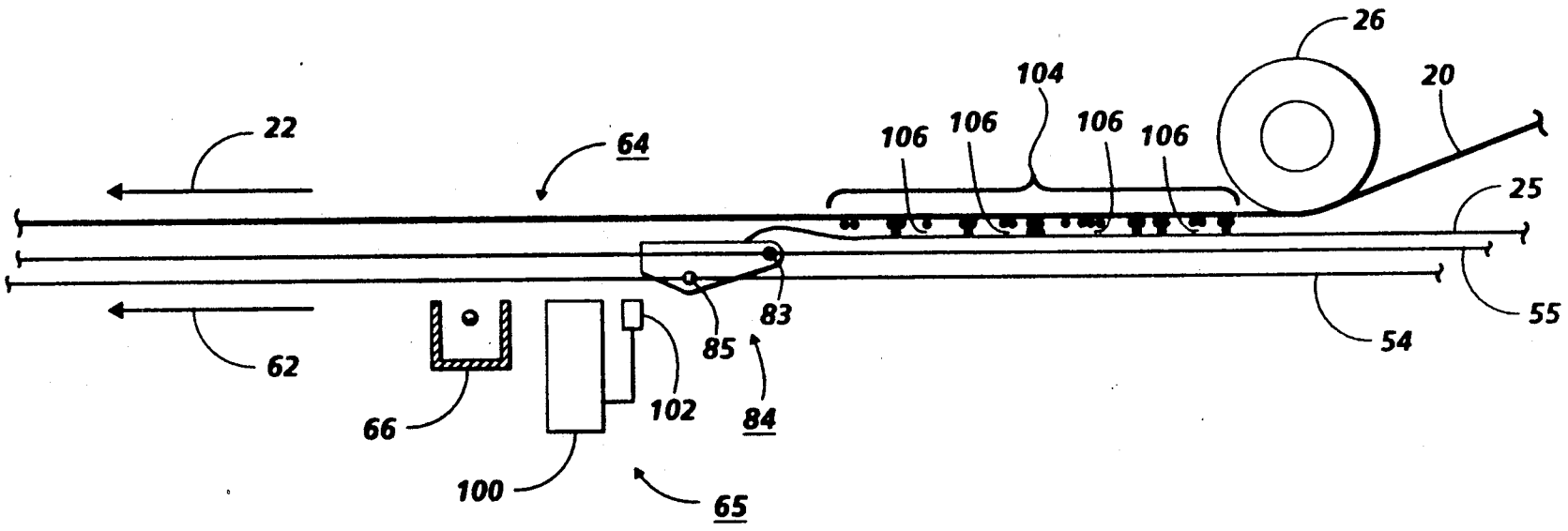
FIG. 8 is a schematic elevational view showing the sheet being transported within the transfer zone with the sheet located at a position prior to passing over the gas directing mechanism of FIG. 7.
Figure 9:
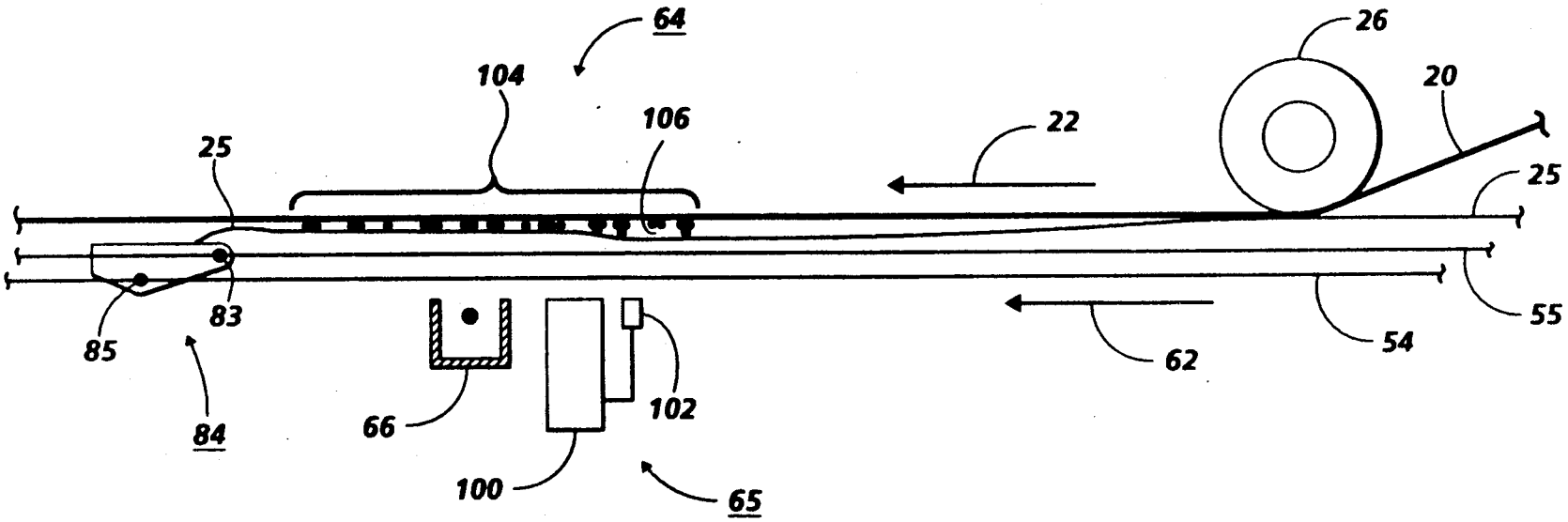
FIG. 9 is a schematic elevational view showing the sheet being transported within the transfer zone with the sheet located at a position partially passed over the gas directing mechanism of FIG. 7.

FIGS. 8 and 9 depict the movement of sheet gripper 84 as it transports sheet 25 having developed image 104 thereon within transfer zone 64. More specifically, FIG. 8 shows sheet gripper 84 transporting sheet 25 in the direction of arrow 62 just prior to passing over gas directing mechanism 100. Prior to passing over the gas directing mechanism, there exists a number gaps 106 between between the sheet 25 and the toner image 104 developed on the photoconductive member 20. Gaps 106 define areas of poor contact between the sheet and the developed image. These poor areas of contact may hinder the transfer of developed image 104 from photoconductive member 20 to sheet 25. With continued advancement of sheet 25, a sensor 102 detects the leading edge of the sheet and transmits a signal to valve 107 causing it to allow a flow of gas to be directed onto sheet 25. The flow of gas is directed onto the side of sheet 25 opposite the side to which developed image 104 is to be transferred. The flow of gas strikes sheet 25 so as to cause the sheet to be urged toward and into contact with the developed toner image thereby reducing the undesirable presence of gaps 106 as shown in FIG. 9. As a result, contact between the sheet and the developed image is enhanced as successive portions of the sheet are advanced over the gas directing mechanism. With further advancement, the sheet passes over the corona generating device 66. The corona generating device establishes a transfer field that is effective to attract the developed toner image from photoconductive member 20 to sheet 25. The sheet is then recirculated so as transfer three different color developed images onto sheet 25 in superimposed registration with one another to form a multi-colored image on the copy sheet.

In recapitulation, the apparatus for transferring a developed image from a photoconductive surface to a copy sheet in a transfer zone includes a mechanism for directing a flow of gas onto the copy sheet in the transfer zone to urge the copy sheet toward the developed image on the photoconductive surface so as to enhance contact between the copy sheet and the developed image in the transfer zone. The apparatus further includes a mechanism for charging the copy sheet in the transfer zone, after the gas directing mechanism directs the flow of gas onto the copy sheet, to attract the developed image from the photoconductive surface to the copy sheet. Moreover, the method of transferring a developed image from a photoconductive surface to a copy sheet in a transfer zone includes the step of directing a flow of gas onto the copy sheet in the transfer zone to urge the copy sheet toward the developed image on the photoconductive surface so as to enhance contact between the copy sheet and the developed image in the transfer zone. The method further includes the step of establishing, in the transfer zone and after the gas directing step, a transfer field that is effective to attract the developed image from the photoconductive surface to the copy sheet.

It is, therefore, apparent that there has been provided in accordance with the present invention, a developed image transfer apparatus and method that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

I claim:

1. An apparatus for transferring a developed image from a photoconductive surface to a copy sheet in a transfer zone, comprising:

means for directing a flow of gas onto the copy sheet in the transfer zone to urge the copy sheet toward the developed image on the photoconductive surface so as to enhance contact between the copy sheet and the developed image in the transfer zone;

means for sensing a leading edge of the copy sheet;

means for activating said gas directing means in response to said sensing means sensing the leading edge of the copy sheet; and means for charging the copy sheet in the transfer zone, after said gas directing means directs the flow of gas onto the copy sheet, to attract the developed image from the photoconductive surface to the copy sheet.

2. The apparatus of claim 1, wherein said activating means comprises a solenoid electrically connected to said sensing means.

3. The apparatus of claim 1, wherein said gas directing means comprises an air compressor for generating the flow of gas.

4. The apparatus of claim 3, wherein said gas directing means further comprises a plenum chamber through which the flow of gas from said air compressor is directed.

5. The apparatus of claim 1, further comprising means for venting gas away from the copy sheet while said gas directing means directs the flow of gas onto the copy sheet.

6. A method of transferring a developed image from a photoconductive surface to a copy sheet in a transfer zone, comprising the steps of:

sensing a leading edge of the copy sheet;

directing a flow of gas onto the copy sheet in the transfer zone in response to the leading edge of the copy sheet being sensed in the sensing step to urge the copy sheet toward the developed image on the photoconductive surface so as to enhance contact between the copy sheet and the developed image in the transfer zone; and establishing, in the transfer zone and after the gas directing step, a transfer field that is effective to attract the developed image from the photoconductive surface to the copy sheet.

7. The method of claim 6, further comprising the step of venting gas away from the copy sheet during the gas directing step.

* * * * *